US009436116B2

(12) United States Patent
Iwasaki

(10) Patent No.: US 9,436,116 B2
(45) Date of Patent: Sep. 6, 2016

(54) CHARGING DEVICE AND IMAGE FORMING APPARATUS

(71) Applicant: FUJI XEROX CO., LTD, Minato-ku, Tokyo (JP)

(72) Inventor: Jin Iwasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 373 days.

(21) Appl. No.: 13/622,840

(22) Filed: Sep. 19, 2012

(65) Prior Publication Data

US 2013/0243485 A1 Sep. 19, 2013

(30) Foreign Application Priority Data

Mar. 16, 2012 (JP) ..... 2012-060585

(51) Int. Cl.
*G03G 15/02* (2006.01)

(52) U.S. Cl.
CPC .... *G03G 15/0233* (2013.01); *G03G 2215/023* (2013.01)

(58) Field of Classification Search
CPC ..... G03G 15/0233; G03G 2215/023
USPC ..... 399/174–176
See application file for complete search history.

(56) References Cited

U.S. PATENT DOCUMENTS 5,805,961 A * 9/1998 Mizoe et al. ..... 399/174
6,173,143 B1 * 1/2001 Hirota et al. ..... 399/176
2002/0021917 A1 * 2/2002 Ishiyama ..... G03G 15/0233 399/175
2008/0038017 A1 * 2/2008 Fujita et al. ..... 399/175
2009/0087212 A1 * 4/2009 Ogura ..... 399/100

FOREIGN PATENT DOCUMENTS

| | | | |
|---|---|---|---|
| JP | 6-43733 | A | 2/1994 |
| JP | 6-194926 | A | 7/1994 |
| JP | 8-152760 | A | 6/1996 |
| JP | 8272188 | A | 10/1996 |
| JP | 10-239946 | A | 9/1998 |
| JP | 10-239951 | A | 9/1998 |
| JP | 200075601 | A | 3/2000 |

OTHER PUBLICATIONS

Communication dated Dec. 28, 2015 from the Japanese Patent Office in counterpart application No. 2012-060585.
Notification of the First Office Action dated Jun. 2, 2016 from the Chinese Patent Office in counterpart application No. 2012104492167.

* cited by examiner

*Primary Examiner* — David Gray
*Assistant Examiner* — Sevan A Aydin
(74) *Attorney, Agent, or Firm* — Sughrue Mion, PLLC

(57) ABSTRACT

A charging device includes a charging member including an endless cylindrical flexible base member and conductive contactors provided along an outer peripheral surface of the base member, the charging member being attracted to a charged member in a pressure applied state by electrostatic attraction force responsive to a charging voltage applied to the charging member or by the electrostatic attraction force and self-weight of the charging member, the charging member charging the charged member; and a voltage applying member that applies the charging voltage to the charging member.

12 Claims, 6 Drawing Sheets

| | SHAFT OF BRUSH ROLLER IS FIXED (FIGS. 4A, 4B) | LOAD APPLIED WITH SPRING TO END PORTION OF BRUSH ROLLER (FIGS. 5A, 5B) | FLEXIBLE BASE MEMBER WITH BRUSH (EXEMPLARY EMBODIMENT) |
|---|---|---|---|
| COMING OFF OF CONTACTORS | NONE | LARGE NUMBER OF CONTACTORS | NONE |
| UNEVEN CHARGING | 50 V | 15 V | 10 V |

CHARGING DEVICE AND IMAGE FORMING APPARATUS

CROSS-REFERENCE TO RELATED APPLICATIONS

This application is based on and claims priority under 35 USC 119 from Japanese Patent Application No. 2012-060585 filed Mar. 16, 2012.

BACKGROUND

1.Technical Field

The present invention relates to a charging device and an image forming apparatus.

2.Related Art

A corona discharge device that is widely used as a charging device that charges a photoconductor drum of an image forming apparatus, such as a copying machine or a printer, is desirable in that the corona discharge device uniformly charges the surface of the photoconductor drum to a predetermined potential. However, such a corona discharge device generates ozone because it makes use of corona discharge.

A charging device for electric discharge over a short distance that charges the surface of a photoconductor drum by electric discharge over a short distance as a result of bringing a charging brush or a charging roller to which a bias voltage is applied into contact with the surface of the photoconductor drum is desirable in that the generation of ozone is suppressed.

SUMMARY

According to an aspect of the invention, there is provided a charging device including a charging member including an endless cylindrical flexible base member and conductive contactors provided along an outer peripheral surface of the base member, the charging member being attracted to a charged member in a pressure applied state by electrostatic attraction force responsive to a charging voltage applied to the charging member or by the electrostatic attraction force and self-weight of the charging member, the charging member charging the charged member; and a voltage applying member that applies the charging voltage to the charging member.

BRIEF DESCRIPTION OF THE DRAWINGS

Exemplary embodiments of the present invention will be described in detail based on the following figures, wherein.

DETAILED DESCRIPTION

Figure 1:
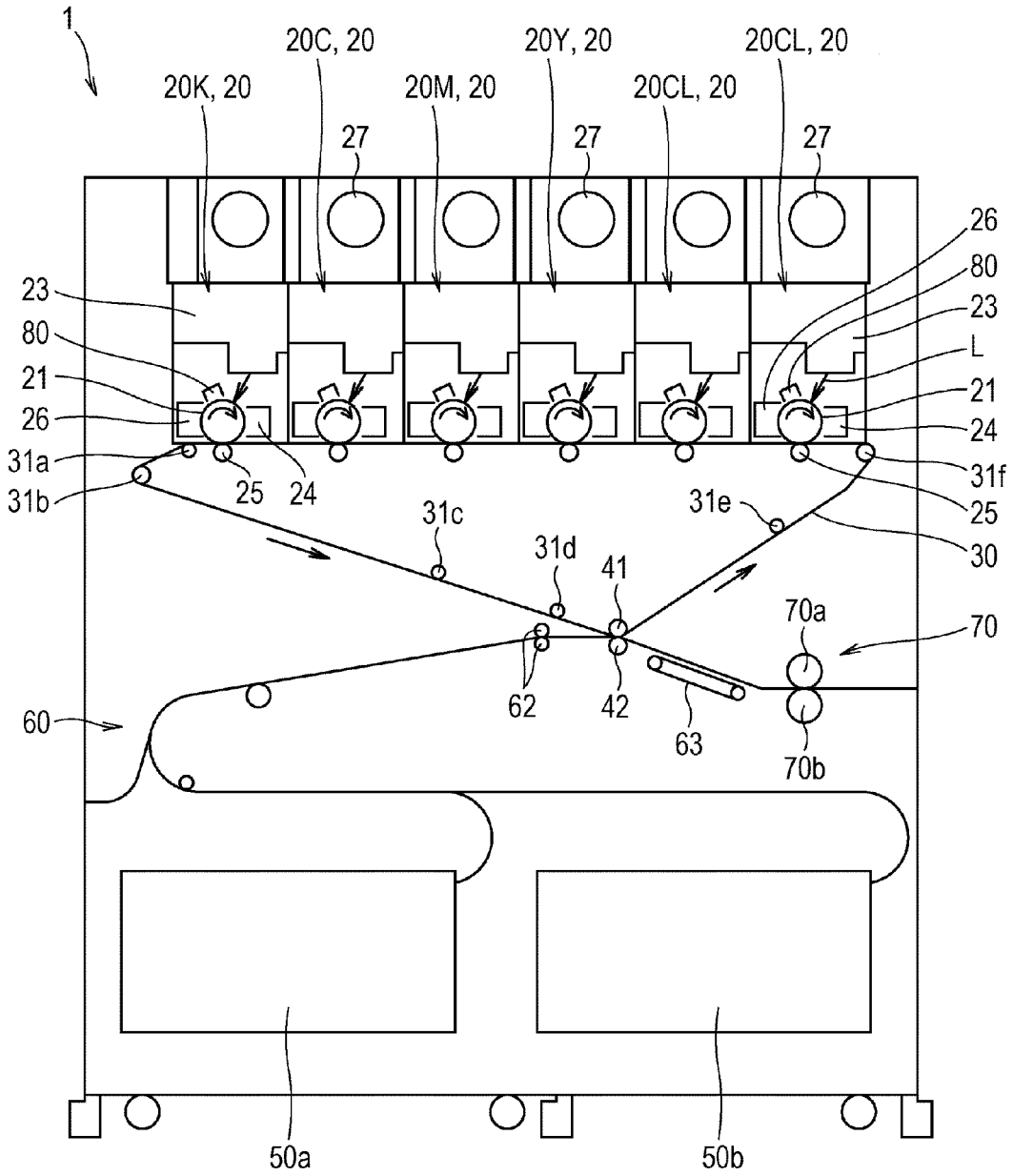
FIG. 1 is a conceptual diagram of an exemplary image forming apparatus according to a first exemplary embodiment of the present invention.

Exemplary embodiments of the present invention will hereunder be described in detail on the basis of the drawings. In the drawings for illustrating the exemplary embodiments, corresponding structural elements are generally given the same reference numerals, and the same descriptions thereof will be omitted.

First Exemplary Embodiment

FIG. 1 is a conceptual diagram of an exemplary image forming apparatus 1 according to a first exemplary embodiment of the present invention.

The image forming apparatus 1 according to the exemplary embodiment is, for example, a tandem color printer, and includes image forming units 20, an intermediate transfer belt (exemplary transfer member) 30, a backup roller 41 and a second transfer roller 42 that form a pair, sheet supply trays 50*a* and 50*b*, a sheet transporting system 60, and a fixing device 70.

The image forming units 20 include four color image forming units 20Y, 20M, 20C, and 20K and transparent-color image forming units 20CL and 20CL. The color image forming units 20Y, 20M, 20C, and 20K form, for example, toner images of four colors, yellow, magenta, cyan, and black. The image forming units 20CL and 20CL transfer, for example, toner images of transparent colors. The toner images formed in accordance with pieces of image information of the corresponding colors are first-transferred to the intermediate transfer belt 30.

The six image forming units 20CL, 20CL, 20Y, 20M, 20C, and 20K are disposed in accordance with a transparent color, a transparent color, yellow, magenta, cyan, and black in that order along the direction of rotation of the intermediate transfer belt 30. Instead of the image forming units for transparent colors, for example, an image forming unit for a light color, such as light yellow, light magenta, light cyan, or light black, that transfers a toner image of a light color may be provided. Alternatively, an image forming unit 20CL for a transparent color and an image forming unit for a light color may both be disposed side by side.

Each image forming unit 20 includes a photoconductor drum (an exemplary charged member) 21, a charging device 80, an exposing device (an exemplary exposing unit) 23, a developing device (an exemplary developing unit) 24, a first transfer roller (an exemplary transferring unit) 25, and a drum cleaner 26. Each charging device 80 charges the surface of its corresponding photoconductor drum 21 to a predetermined potential. Each exposing device 23 irradiates the corresponding charged photoconductor drum 21 with laser light L to form an electrostatic latent image. Each developing device 24 develops the electrostatic latent image formed on the corresponding photoconductor drum 21 by the corresponding exposing device 23 to form a toner image. Each first transfer roller 25 transfers the toner image carried on its corresponding photoconductor drum 21 to the intermediate transfer belt 30 at a first transfer section. Each drum cleaner 26 removes, for example, residual toner or paper powder from the surface of its corresponding photoconductor drum 21 after the transfer of the toner image. Toner cartridges 27 that supply developer to the developing devices 24 are set at upper sides of the respective image forming units 20.

The first transfer rollers 25 of the respective image forming units 20 are disposed so that the first transfer rollers 25 and the corresponding photoconductor drums 21 nip the intermediate transfer belt 30. By applying a transfer bias voltage having a polarity that is opposite to that of a charging polarity of toner to each first transfer roller 25, electric fields are formed between the photoconductor drums 21 and the corresponding first transfer rollers 25. Therefore, the toner images that are charged on the corresponding photoconductor drums 21 are transferred to the intermediate transfer belt 30 by coulomb forces.

The intermediate transfer belt 30 is a member to which the toner images of the corresponding color components, formed by the corresponding image forming units 20, are successively transferred (first-transferred) for carrying the toner images. The intermediate transfer belt 30 is an endless belt that is placed on supporting rollers 31*a* to 31*f* and the backup roller 41. The toner images formed by the corresponding image forming units 20CL, 20CL, 20Y, 20M, 20C, and 20K are first-transferred to the intermediate transfer belt 30 while the intermediate transfer belt 30 rotates counterclockwise.

The backup roller 41 and the second transfer device 42 that form a pair constitute a mechanism for forming a full-color image by collectively transferring (second-transferring) the toner images transferred to and superimposed on the intermediate transfer belt 30 to, for example, a sheet (an exemplary transfer material), and are disposed so as to oppose each other with the intermediate transfer belt 30 being nipped therebetween. A portion where the backup roller 41 and the second transfer device 42 oppose each other corresponds to a second transfer nip section.

The backup roller 41 is rotatably set at the inner surface of the intermediate transfer belt 30. The second transfer device 42 is rotatably set while opposing a toner-image transfer surface of the intermediate transfer belt 30. The backup roller 41 and the second transfer device 42 are disposed so that their directions or rotational axes (that is, their directions perpendicular to the plane of FIG. 1) are parallel to each other.

When transferring the toner images on the intermediate transfer belt 30, a voltage whose polarity is the same as the toner charging polarity is applied to the backup roller 41, or a voltage whose polarity is opposite to the toner charging polarity is applied to the second transfer device 42. This causes a transfer electric field to be formed between the backup roller 41 and the second transfer device 42, so that unfixed toner images carried by the intermediate transfer belt 30 are transferred to a sheet.

For example, sheets of various sizes and thicknesses are held in the sheet supply trays 50*a* and 50*b*. The sheets in the sheet supply trays 50*a* and 50*b* are drawn out by a pickup roller (not shown) of the sheet transporting system 60. Then, a timing is controlled by registration rollers 62 of the sheet transporting system 60, and the sheets are introduced into the second transfer nip section, so that the toner images are transferred to the sheets. Thereafter, the sheets are transported to the fixing device 70 by a transporting belt 63 of the sheet transporting system 60.

The fixing device 70 fixes unfixed toner images, transferred to, for example, a sheet at a second transfer section, to the sheet by thermocompression. The fixing device 70 includes a heating roller 70*a* and a pressure roller 70*b*, provided so as to oppose the heating roller 70*a*.

After the second transfer, the sheet is transported to a fixing nip section where the heating roller 70*a* and the pressure roller 70*b* oppose each other, and is discharged while being nipped between the heating roller 70*a* and the pressure roller 70*b*. At this time, for example, the sheet is heated by the heating roller 70*a*, and is pressed by the pressure roller 70*b*, so that the toner images are fixed to, for example, the sheet. For example, the sheet that has passed through the fixing device 70 is sent to a discharge roller (not shown) by a transporting belt 65, and is discharged to the outside of the image forming apparatus 1.

Figure 2:
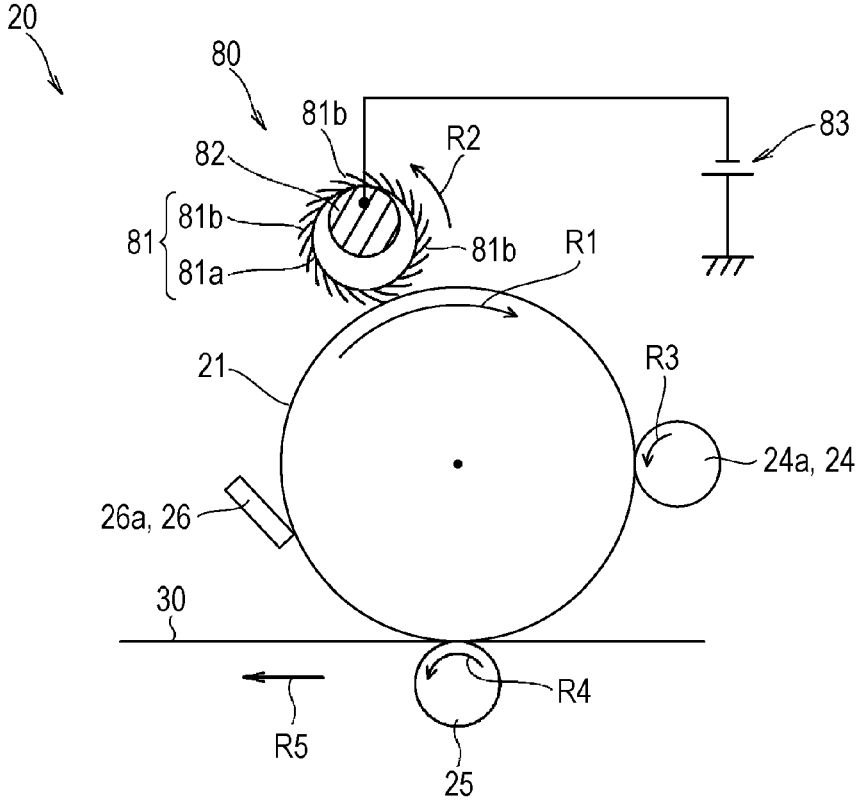
FIG. 2 is a conceptual diagram of an image forming unit of the image forming apparatus shown in FIG. 1.
Figure 3:
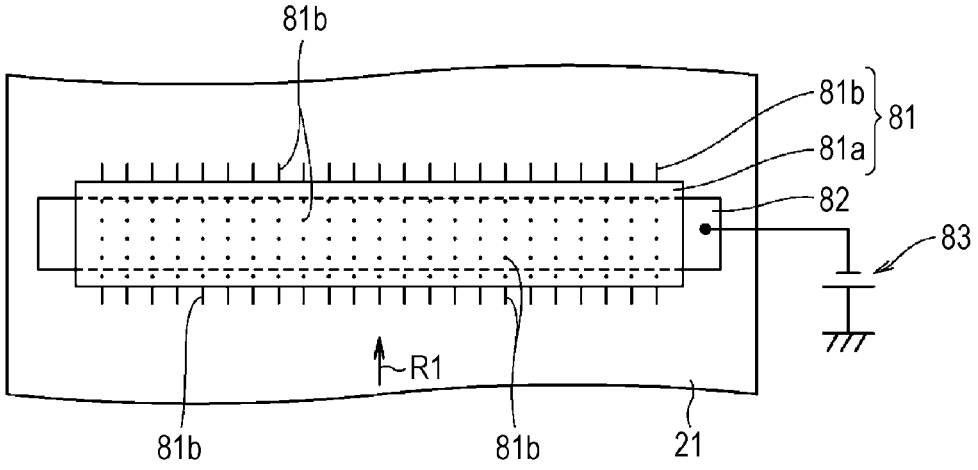
FIG. 3 is a plan view of a charging brush as seen from the top of FIG. 2.

FIG. 2 is a conceptual diagram of an image forming unit 20 of the image forming apparatus 1 shown in FIG. 1. FIG. 3 is a plan view of a charging brush 81 of the charging device 80 as seen from the top of FIG. 2.

Each photoconductor drum 21 is a cylindrical drum, and is provided so as to be rotationally driven clockwise in the direction of arrow R1. Each photoconductor drum 21 is formed by placing photosensitive layers (not shown), such as a charge generating layer and a charge transporting layer, along an outer periphery of a cylindrical conductive substrate (not shown). The cylindrical conductive substrate of each photoconductor drum 21 is electrically connected to a ground potential.

As shown in FIG. 2, the charging brush (an exemplary charging member) 81 of the charging device 80, a development roller 24*a* of the developing device 24, the first transfer roller 25, and a blade 26*a* of the drum cleaner 26 are disposed along an outer periphery of each photoconductor drum 21 in the direction of arrow R1. Arrows R2 to R5 shown in FIG. 2 indicate the direction of rotation of each charging brush 81, the direction of rotation of each development roller 24*a*, the direction of rotation of each first transfer roller 25, and the direction of rotational movement of the intermediate transfer belt 30, respectively.

At a location above the outer periphery of each photoconductor drum 21, the charging brush 81 of each charging device 80 is supported by its corresponding shaft 82 while opposing its corresponding photoconductor drum 21 and while being rotatable so as to be driven by the rotation of its corresponding photoconductor drum 21. Each charging brush 81 includes an endless cylindrical conductive flexible base member 81*a* and conductive contactors 81*b* provided along the outer peripheral surface of the corresponding flexible base member 81*a*.

The flexible base members 81*a* of the respective charging brushes 81 are formed of, for example, conductive films having thicknesses of from 30 to 200 μm. Each flexible base member 81*a* is formed by mixing conductive particles, such as carbon black, metallic powder, or metal oxide, in resin or synthetic rubber. Examples of resin include polyester, polyamide, polyimide, polyethylene, polycarbonate, polyolefin, polyurethane, polyvinylidene fluoride, polyethylene terephthalate (PEN), polyetherketone (PEK), polyethersulfone (PES), polyphenylene sulfide (PPS), and fluorocarbon resins (such as PFA, PVDF, ETFE, and CTFE). Examples of synthetic rubber are silicone rubber, ethylene propylene diene monomer (EPDM), ethylene propylene rubber, butyl rubber, acrylic rubber, urethane rubber, and nitrile rubber.

The contactors 81*b* of each of the above-described charging brushes 81 are provided at an outer peripheral surface of each of the flexible base members 81*a* by an electrostatic flocking process. That is, the contactors 81*b* are affixed to the outer peripheral surface of each flexible base member 81*a* with a conductive adhesive applied to the outer peripheral surface of each flexible base member 81*a*. The cost of the charging brushes 81 when the charging brushes 81 formed by the electrostatic flocking process are used is less than that when charging brushes formed by pile-weaving contactors are used.

The contactors 81*b* have, for example, a fineness of 2 to 3 deniers and are relatively thin. The contactors 81*b* are formed of conductive fibers having a length on the order of 0.5 to 1.5 mm, and are provided so as to extend radially from the outer periphery of the flexible base member 81*a*. Each contactor 81*b* is formed by mixing conductive particles, such as carbon black, in, for example, nylon, rayon, or polyester. The adhesive that affixes the contactors 81*b* is formed of, for example, acrylic resin, urethane resin, or epoxy resin.

The contactors 81*b* may be obliquely laid along the corresponding flexible base member 81*a*. This reduces uneven charging.

When the direction in which the contactors 81*b* are obliquely laid is such that the ends of the contactors 81*b* are oriented downstream in the direction of rotation of the photoconductor drums 21 (that is, obliquely rightward in FIG. 2) as seen from the position where the charging brush 81 and the corresponding photoconductor drum 21 contact each other, uneven charging is often reduced. Therefore, in the exemplary embodiment of the present invention, the contactors 81*b* are obliquely laid in this direction. However, due to compatibility with an image forming system, the contactors 81*b* may be oriented in the opposite direction. Therefore, the direction in which the contactors are laid is not limited.

Each shaft 82 that supports its corresponding charging brush 81 is formed so that its diameter is less than the inside diameter of the flexible base member 81*a*. Each shaft 82 is inserted in a cylinder of its corresponding flexible base member 81*a* while a portion of an outer periphery of each shaft 82 contacts a portion of an inner periphery of the corresponding flexible base member 81*a*. Here, although each shaft 82 is rotatably provided so as to be driven by the rotation of its corresponding charging brush 81, each shaft 82 may be made rotatable around an axis by a rotating driving member such as a motor, or each shaft 82 may be in a fixed state if the friction between each charging brush 81 and its corresponding shaft 82 is small.

Each shaft 82 is formed of a metal such as aluminum or stainless steel. Instead of being formed of a metal, each shaft 82 may be formed by mixing conductive particles, such as carbon black, metallic powder, or metal oxide, in resin or synthetic rubber. Examples of resin include polyester, polyamide, polyethylene, polycarbonate, polyolefin, polyurethane, polyvinylidene fluoride, polyimide, PEN, PEK, PES, PPS, PFA, PVDF, ETFE, and CTFE). Examples of synthetic rubber are silicone rubber, EPDM, ethylene propylene rubber, butyl rubber, acrylic rubber, urethane rubber, and nitrile rubber. Each shaft 82 may be one in which a coating is applied to the surface of each shaft 82 formed of a material that is mainly the aforementioned resin or rubber. The coating is made conductive by adding a conductive filler, such as carbon black, metallic powder, or metal oxide, to a high-polymer binder, such as acryl or epoxy. Alternatively, each shaft 82 may be one in which a film is formed on the surface of, for example, a hollow rod formed of, for example, metal or resin. The film is one whose resistance is adjusted, such as a film formed of amorphous silicon having added thereto an impurity or titanium oxide. Still alternatively, each shaft 82 may be one in which a hollow rod, itself, formed of, for example, resin is made conductive.

Each shaft 82 is electrically connected to, for example, a direct-current power supply 83. Each direct-current power supply 83 applies charging voltage to its corresponding charging brush 81. The applied voltage of each direct-current power supply 83 is, for example, −900 V, in which case, the potential to which the surface of its corresponding photoconductor drum 21 is charged is, for example, −450 V.

By using each shaft 82 that supports its corresponding charging brush 81 as a voltage applying member that applies charging voltage, the structure is simplified and each charging device 80 is reduced in size compared to when each shaft 82 is separately provided. When direct-current voltage is used as the charging voltage, the structure is simplified and control is facilitated, so that costs of a power supply system are reduced. Instead of the direct-current power supplies 83, for example, power supplies that apply voltage in which alternating-current voltage is superimposed upon direct-current voltage may also be used.

For example, two methods shown in FIGS. 4A to 5B are available as methods of charging the surface of a photoconductor drum 21 using a charging brush.

Figure 4A:
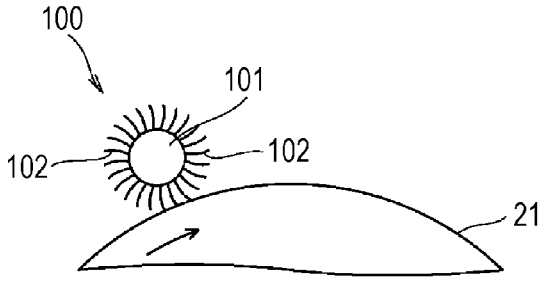
FIG. 4A is a conceptual diagram of a brush roller when charging is performed.

The method shown in FIG. 4A is a method of fixing a shaft 101, which supports a brush roller 100, at a preset distance from the photoconductor drum 21. The method shown in FIG. 4B is a method of bringing only an end portion of a contactor 102 of the brush roller 100 into contact with the surface of the photoconductor drum 21 when charging is performed.

Figure 5A:
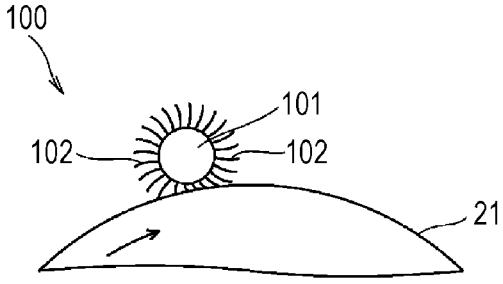
FIG. 5A is a conceptual diagram of the brush roller when charging is performed.
Figure 5B:
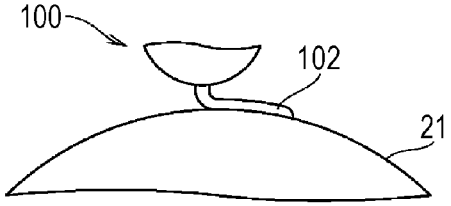
FIG. 5B is an enlarged view of a principal portion of FIG. 5B.

The method shown in FIG. 5A is a method of applying a load to an end portion of the shaft 101, which supports the brush roller 100, with a spring and pushing the shaft 101 against the surface of the photoconductor drum 21 so as to contact the surface of the photoconductor drum 21. The method shown in FIG. 5B is a method of laying contactors 102 when charging is performed.

Figure 4B:
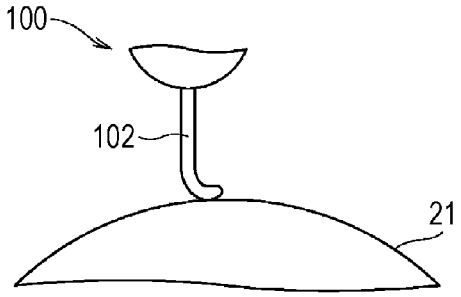
FIG. 4B is an enlarged view of a principal portion of FIG. 4A.

In the methods shown in FIGS. 4A and 4B, since the contactors 102 tend to stand, a discharge area is not long, as a result of which uneven charging tends to increase. In the methods shown in FIGS. 5A and 5B, by pushing the shaft 101 against the photoconductor drum 21 and laying the contactors 102, the discharge area tends to be long, as a result of which uneven charging is reduced. Therefore, the methods shown in FIGS. 5A and 5B may be selected. However, when the contactors 102 are affixed with an adhesive by an electrostatic flocking process, the contactors 102 tend to come off. Moreover, as shown in FIGS. 5A and 5B, when the shaft 101 is pushed against the photoconductor drum 21, excessive pressure is applied to the contactors 102 and an adhesive layer, as a result of which the contactors 102 come off.

Figures 6, 7:
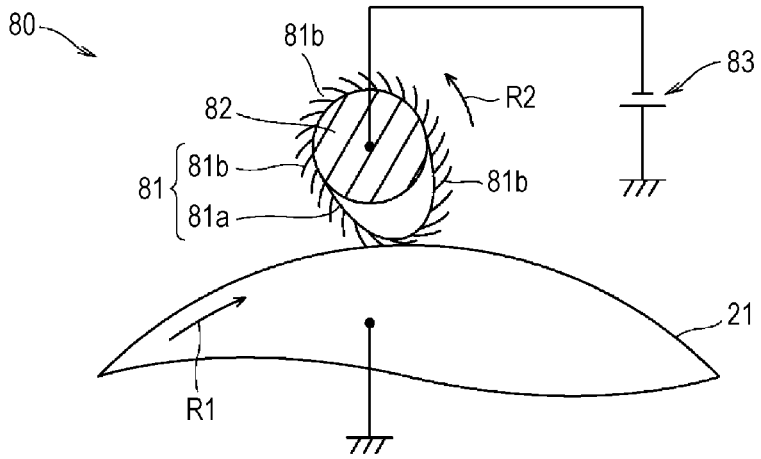
FIG. 6 is a conceptual diagram of a charging brush when charging is performed by a charging device which constitutes the image forming unit of the image forming apparatus shown in FIG. 1.
FIG. 7 gives a summary of uneven charging and coming off of contactors in charging operations shown in FIGS. 4A to 6.

FIG. 6 is a conceptual diagram of the charging brush 81 when charging is performed by the charging device 80 according to the exemplary embodiment.

In the exemplary embodiment, in charging each photoconductor drum 21, when charging voltage is applied to each shaft 82 from the corresponding direct-current power supply 83, the charging voltage is applied to the corresponding charging brush 81 through the inner side of the cylinder of the flexible base member 81*a* from the corresponding shaft 82. When the charging voltage is applied to each charging brush 81 in this way, by electrostatic force that is generated between each charging brush 81 and its corresponding photoconductor drum 21 and the self-weight (or a portion of the self-weight) of each charging brush 81, each charging brush 81 is attracted to its corresponding photoconductor drum 21 in a pressure applied state, so that each charging brush 81 in a flexed state contacts the surface of its corresponding photoconductor drum 21. In this state, electric discharge over a short distance is generated in a gap in a portion where each charging brush 81 and its corresponding photoconductor drum 21 contact each other, so that the surface of each photoconductor drum 21 is charged to a predetermined potential.

That is, in the exemplary embodiment, the charging brushes 81 are not pushed against the corresponding photoconductor drums 21 by, for example, a spring load, and the charging brushes 81 are brought into contact with the corresponding photoconductor drums 21 by only electrostatic attraction forces and the self-weights (or portions of the self-weights) of the charging brushes 81. Therefore, excess pressure is not applied to the adhesive layer and the contactors 81*b* of each charging brush 81. For this reason, the coming off of the contactors 81*b* caused by excess load is suppressed or is prevented.

When the charging brushes 81 are attracted to the corresponding photoconductor drums 21 by the electrostatic forces and the self-weights (or portions of the self-weights) of the charging brushes 81 while pressure is applied to the photoconductor drums 21, the contactors 81*b* of the charging brushes 81 are sufficiently laid. Therefore, the discharge area is long, as a result of which uneven charging is reduced. Moreover, the flexible base members 81*a* are flexible compared to, for example, metallic shafts. Therefore, the width of contact between each charging brush 81 and its corresponding photoconductor drum 21 caused by the electrostatic attraction force is large, and the angle of each wedge portion in front of and behind the contact portion becomes an acute angle, so that the discharge area is long. Consequently, uneven charging is correspondingly reduced.

FIG. 7 gives a summary of uneven charging and coming off of contactors in the charging operations shown in FIGS. 4A to 6. In the charging operations shown in FIGS. 4A and 4B, although the contactors 102 do not come off, uneven charging is 50 V. In the charging operations shown in FIGS. 5A and 5B, excess load is applied to, for example, the contactors 102 and a large number of contactors 102 come off, and uneven charging is 15 V. In contrast, in the exemplary embodiment shown in FIG. 6, it is understood that the contactors 81*b* do not come off, and uneven charging is on the order of 10 V, and is less than those in FIG. 4A to FIG. 5B.

In the exemplary embodiment, since the position of each charging brush 81 is disposed above its corresponding photoconductor drum 21, each charging brush 81 and its corresponding photoconductor drum 21 are in contact with each other only by the self-weight (or a portion of the self-weight) and electrostatic attraction force. Therefore, good results are obtained as mentioned above. When each charging brush 81 is disposed below its corresponding photoconductor drum 21, the self-weight component disappears, so that each photoconductor drum 21 and its corresponding charging brush 81 contact each other only by electrostatic attraction force. Even in this case, excess pressure that causes the contactors 81*b* to come off is not applied. In addition, the contactors 81*b* are sufficiently laid even by electrostatic attraction force alone, so that the discharge area is long, as a result of which uneven charging is reduced.

Second Exemplary Embodiment

Figure 8:
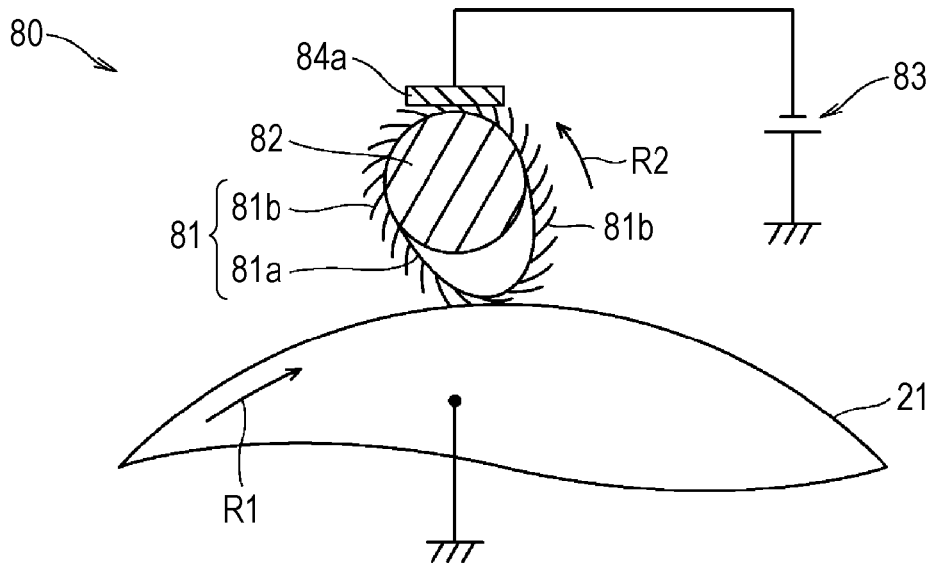
FIG. 8 is a conceptual diagram of a charging brush when charging is performed by a charging device according to a second exemplary embodiment of the present invention.

FIG. 8 is a conceptual diagram of a charging brush 81 when charging is performed by a charging device 80 according to a second exemplary embodiment.

In the exemplary embodiment, charging voltage is applied to each charging brush 81 from its corresponding plate-shaped charging electrode 84*a*, provided at an outer side of a cylinder of the corresponding charging brush 81. Each charging electrode 84*a* is formed of a metal, such as aluminum or stainless steel, is electrically connected to its corresponding direct-current power supply 83, and is secured while in contact with an outer periphery of its corresponding charging brush 81 when charging is performed.

Since charging voltage is applied from the outer side of the cylinder of each charging brush 81, the charging voltage is applied to each charging brush 81 even if its corresponding flexible base member 81*a* is formed of an insulating material. That is, since a low-cost insulating base member is used for each flexible base member 81*a*, the cost of each charging brush 81 is reduced.

Since the charging voltage is applied from the outer side of the cylinder of each charging brush 81, each shaft 82 that supports its corresponding charging brush 81 may be formed of an insulating material. The insulating material of each shaft 82 in this case is, for example, polyester, polyamide, polyethylene, polycarbonate, polyolefin, polyurethane, polyvinylidene fluoride, acryl, polyacetal (POM), phenol, or a fluorinated high-polymer material. In order to strengthen each shaft 82, an outer periphery of each metallic shaft may have a roller shaft structure including an insulating layer formed of, for example, polyurethane.

Each charging electrode 84*a* may be formed of, for example, a conductive sponge, nonwoven fabric, a blade, or a brush. If each charging electrode 84*a* is formed of a brush, each charging electrode 84*a* softly contacts the outer periphery of its corresponding charging brush 81. Therefore, the coming off of each contactor 81*b* when each charging electrode 84*a* contacts its corresponding charging brush 81 is suppressed or prevented. In addition, when each charging electrode 84 is formed of a brush, its resistance with respect to the rotation of its charging brush 81 is reduced. Therefore, power supply is stably performed.

Third Exemplary Embodiment

Figure 9:
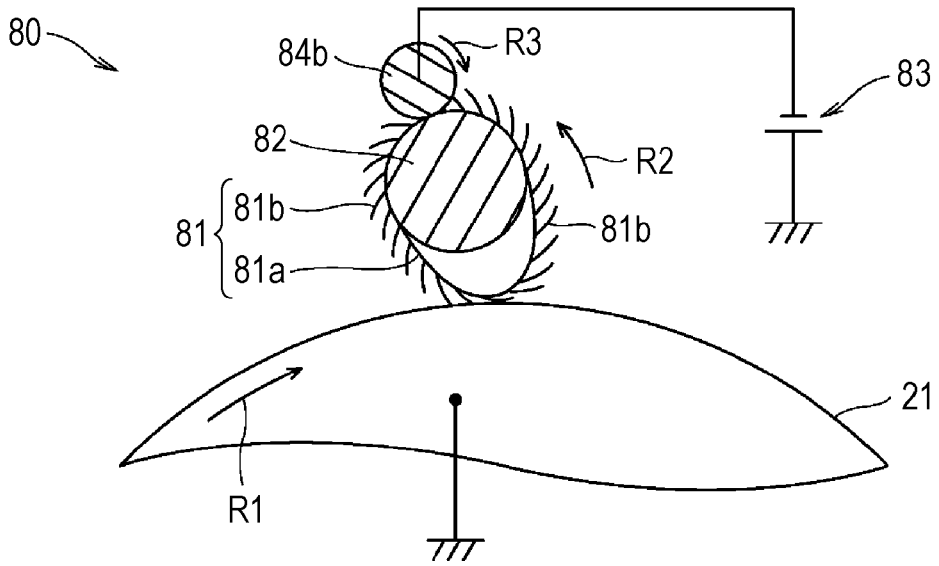
FIG. 9 is a conceptual view of a charging brush when charging is performed by a charging device according to a third exemplary embodiment of the present invention.

FIG. 9 is a conceptual view of a charging brush 81 when charging is performed by a charging device 80 according to a third exemplary embodiment of the present invention.

In the exemplary embodiment, charging voltage is applied to each charging brush 81 from a roller charging electrode 84*b* provided at an outer side of a cylinder of its corresponding charging brush 81. Each charging electrode 84*b* includes, for example, a shaft and an elastic layer provided along an outer periphery thereof. Each shaft is formed of a metal, such as aluminum or stainless steel, and is electrically connected to its corresponding direct-current power supply 83. Each elastic layer is formed of conductive rubber in which conductive particles, such as carbon black, are dispersed in EPDM.

By forming each elastic layer along an outer periphery of its corresponding roller charging electrode 84*b* out of conductive rubber, each charging electrode 84*b* softly contacts its corresponding charging brush 81. Therefore, the coming off of each contactor 81*b* when each charging electrode 84*b* contacts its corresponding charging brush 81 is suppressed or prevented.

Each roller charging electrode 84*b* is provided so as to contact an outer periphery of its corresponding brush 81 when charging is performed, and so as to be rotatable in the direction of arrow R3 in such a way as to be driven by the rotation of its corresponding charging brush 81.

However, each roller charging electrode 84*b* may be rotated by a rotating driving member (such as a motor) so that a uniform speed is achieved in accordance with the rotation of its corresponding charging brush 81. In this case, the rotation of each charging brush 81 is not interfered with, so that power supply is stably carried out.

Each roller charging electrode 84*b* may be formed of, for example, only conductive resin or rubber, or sponge or a brush. When a brush-roller charging electrode is used, each charging electrode 84*b* softly contacts the outer periphery of its corresponding charging brush 81. Therefore, the coming off of each contactor 81*b* when each charging electrode 84*b* contacts its corresponding charging brush 81 is suppressed or prevented. In addition, when a brush-roller charging electrode is used, the resistance with respect to the rotation of each charging brush 81 is further reduced, so that power supply is stably carried out.

Each shaft 82 that supports its corresponding charging brush 81 is the same as that in the first exemplary embodiment and that in the second exemplary embodiment, and will not be described below.

Fourth Exemplary Embodiment

Figure 10:
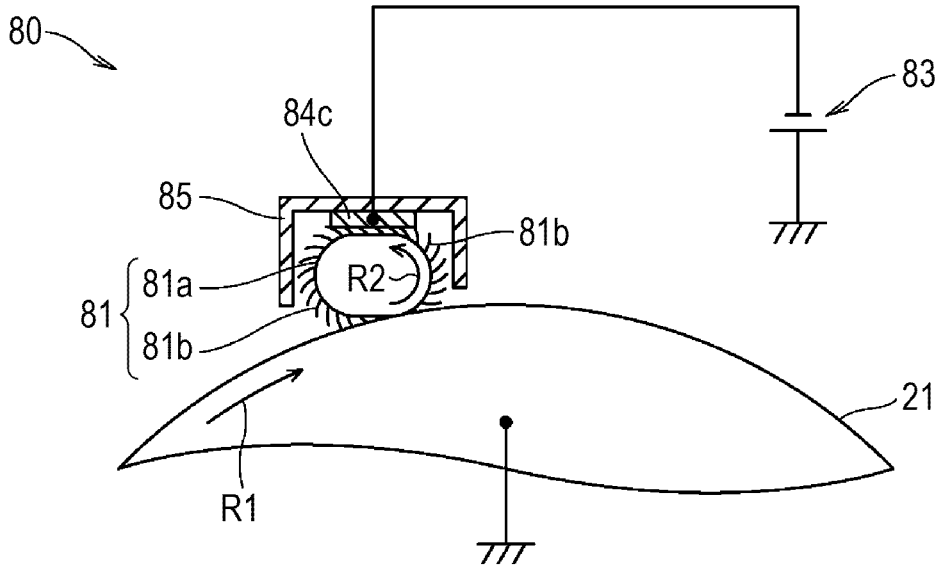
FIG. 10 is a conceptual view of a charging brush when charging is performed by a charging device according to a fourth exemplary embodiment of the present invention.

FIG. 10 is a conceptual view of a charging brush 81 when charging is performed by a charging device 80 according to a fourth exemplary embodiment of the present invention.

In the exemplary embodiment, a frame-shaped supporting member 85 that supports its corresponding charging brush 81 so as to surround it is provided in a fixed state at an outer side of a cylinder of its corresponding charging brush 81 so as not to move.

In this case, since each charging brush 81 is supported by its corresponding frame-shaped supporting member 85 at an outer side of a cylinder of each charging brush 81, it is not necessary to use a supporting member, such as a shaft 82, at an inner side of the cylinder of each charging brush 81. That is, since it is not necessary to use a high-cost member, such as a shaft 82, the cost of each charging brush 81 is reduced.

Each supporting member 85 is formed of, for example, insulating resin, such as propylene. A charging electrode 84*c* that applies charging voltage to its corresponding charging brush 81 is provided at a ceiling surface at an inner side of a frame of its corresponding supporting member 85. The structure of each charging electrode 84*c* is the same as that of each charging electrode 84*a* in the second exemplary embodiment and that of each charging electrode 84*b* in the third exemplary embodiment, so that it will not be described.

Although the invention carried out by the inventors is described in detail on the basis of exemplary embodiments, the exemplary embodiments disclosed in the specification are exemplifications on all points, and should not to be thought of as limiting the disclosed technology. That is, the technical scope of the present invention is not to be construed in a limited sense on the basis of the explanation in the exemplary embodiments. The technical scope of the present invention should be strictly construed in accordance with the scope of the claims. Accordingly, technologies that are equivalent to the technology that is set forth in the scope of the claims and all modifications that do not depart from the gist of the scope of the claims are included.

For example, although, in the exemplary embodiments, the invention is applied to an intermediate-transfer image forming apparatus that transfers a toner image transferred to an intermediate transfer belt to a sheet is described, the invention is not limited thereto. The invention may be applied to a direct-transfer image forming apparatus that directly transfers a toner image on a photoconductor drum to, for example, a sheet.

Although, in the exemplary embodiments, the formation of color images is described, for example, monochrome images may be formed.

Although, in the exemplary embodiments, a sheet is used as a recording medium, the present invention is not limited thereto. For example, a film, a postcard, or various other materials on which images are formed may be used.

Although, in the foregoing description, the present invention is applied to a color printer, the present invention may be applied to, for example, a color copying machine, a facsimile, an image forming apparatus having the functions of both the color copying machine and the facsimile, and other types of image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member configured to charge a charged member and comprising:

an endless cylindrical flexible base member;

a single shaft provided inside the flexible base member and configured to support the flexible base member; and a plurality of conductive contactors comprising conductive fibers provided along an outer peripheral surface of the base member, a first end of a conductive fiber of the conductive fibers affixed to the base member, the conductive fiber extending in a slanted direction with respect to a radial direction of the single shaft such that a second end opposite to the first end of the conductive fiber is provide downstream from the first end along a rotational direction of the charged member and along a rotational direction of the flexible base member; and a voltage applying member configured to apply a charging voltage to the charging member, wherein a diameter of the outer surface of the shaft is smaller than an inner diameter of the flexible base member, and wherein the charging member is rotated in a direction opposite to the rotational direction of the charged member.

2. The charging device according to claim 1, wherein the contactors are provided to the outer surface of the base member by an electrostatic flocking process.

3. The charging device according to claim 1, wherein the charging member is attracted to the charged member by only the electrostatic attraction force or by only the electrostatic attraction force and the self-weight.

4. The charging device according to claim 1, wherein the voltage applying member is provided at an inner side of the base member so as to apply the charging voltage from the inner side of the base member.

5. The charging device according to claim 1, wherein the voltage applying member is provided at an outer side of the base member so as to apply the charging voltage from the outer side of the base member.

6. The charging device according to claim 5, further comprising a supporting member that supports the charging member and surrounds a portion of the charging member, wherein the voltage applying member is provided to the supporting member.

7. An image forming apparatus comprising:

the charging device according to claim 1 configured to charge a surface of the charged member;

an exposing unit configured to expose the charged member to form an electrostatic latent image;

a developing unit configured to develop the electrostatic latent image; and a transferring unit configured to transfer the electrostatic image to a transfer member.

8. The charging device according to claim 1, wherein in response to the charging voltage being applied to the charging member, the charging member is attracted to a charged member in a pressure applied state by electrostatic attraction force or by self-weight of the charging member and the electrostatic attraction force.

9. The charging device according to claim 1, wherein the outer surface of the shaft only contacts only a portion of an inner surface of the flexible base member.

10. The charging device according to claim 1, wherein the charging member is driven by the charged member.

11. The charging device according to claim 1, wherein the flexible base member suspends from the single shaft.

12. A charging device comprising:

a charging member configured to charge a charged member and comprising:

an endless cylindrical flexible base member;

a shaft provided inside the flexible base member and configured to support the flexible base member; and a plurality of conductive contactors comprising conductive fibers provided along an outer peripheral surface of the base member, a first end of a conductive fiber of the conductive fibers affixed to the base member, the conductive fiber extending in a slanted direction with respect to a radial direction of the single shaft such that a second end opposite to the first end of the conductive fiber is provide downstream from the first end along a rotational direction of the charged member and along a rotational direction of the flexible base member; and a voltage applying member configured to apply a charging voltage to the charging member, wherein a diameter of the outer surface of the shaft is smaller than an inner diameter of the flexible base member, and wherein the shaft is provided at a preset distance from the charged member, and wherein the charging member is rotated in a direction opposite to the rotational direction of the charged member.

* * * * *